US006299060B1

(12) United States Patent
Garran

(10) Patent No.: US 6,299,060 B1
(45) Date of Patent: Oct. 9, 2001

(54) GIFT RECEPTACLE AND KIT FOR ASSEMBLING SAME

(75) Inventor: Joseph F. Garran, Strongsville, OH (US)

(73) Assignee: Vanguard Marketing Group, Inc., Northfield, OH (US)

( * ) Notice: Subject to any disclaimer, the term of this patent is extended or adjusted under 35 U.S.C. 154(b) by 0 days.

(21) Appl. No.: 09/769,972

(22) Filed: Jan. 25, 2001

Related U.S. Application Data

(60) Provisional application No. 60/178,799, filed on Jan. 28, 2000.

(51) Int. Cl.[7] ..... B65D 25/00

(52) U.S. Cl. ..... 229/116.4; D9/322; 206/457; 493/162

(58) Field of Search ..... 229/116.4; 206/457; 446/77, 79, 478; D9/322; 493/114, 162

(56) References Cited

U.S. PATENT DOCUMENTS

| | | | | |
|---|---|---|---|---|
| D. 305,979 | | 2/1990 | Parker . | |
| 1,698,731 | * | 1/1929 | Otto | 446/79 |
| 2,020,196 | * | 11/1935 | Mallgraf | 446/478 |
| 2,636,313 | * | 4/1953 | Shank | 229/116.4 |
| 3,343,297 | * | 9/1967 | Valentine | D9/322 |
| 3,832,800 | * | 9/1974 | Selesny | 446/77 |
| 4,131,227 | * | 12/1978 | Patton et al. | 229/116.4 |
| 4,765,006 | * | 8/1988 | Jackson et al. | 446/478 |
| 5,096,204 | * | 3/1992 | Llppman | 446/478 |
| 5,100,002 | | 3/1992 | Garran . | |
| 5,394,989 | | 3/1995 | Delson . | |
| 5,525,088 | * | 6/1996 | Mayne | 206/457 |

* cited by examiner

*Primary Examiner*—Gary E. Elkins
(74) *Attorney, Agent, or Firm*—Renner, Kenner, Greive, Bobak, Taylor & Weber

(57) ABSTRACT

A gift receptacle having the exterior appearance of a castle and kit for assembly is provided by the present invention. The castle-shaped gift receptacle comprises a bottom, four upright sides and a roof having a centrally disposed slot. The gift receptacle further comprises at least one corner base tower, a rectangular roof tower base, at least one roof tower, and optionally at least one tower cap. The kit comprises a flexible waterproof package, a plurality of pieces of foldable, self-supporting sheet material which are to be folded into the different component shapes of the castle-shaped gift receptacle, and printed instructions for the assembly of the gift receptacle.

23 Claims, 5 Drawing Sheets

GIFT RECEPTACLE AND KIT FOR ASSEMBLING SAME

CROSS REFERENCE TO RELATED APPLICATIONS

The present application claims priority from U. S. Provisional Patent Application No. 60/178,799, filed on Jan. 28, 2000.

FIELD OF THE INVENTION

The present invention relates to a gift receptacle for greeting cards, cash, checks, gift certificates, and the like. The present invention more particularly relates to a gift receptacle having the exterior appearance of a castle structure and a kit containing the required materials for the assembly of a gift receptacle.

BACKGROUND OF THE INVENTION

There are many special or festive occasions in which family members and other guests give gifts to the person or persons being recognized, such as wedding receptions, bridal showers, baby showers, anniversaries, birthday parties, graduation parties, retirement parties, "housewarming" parties, and the like. Furthermore, there are many religious occasions in which guests traditionally give gifts such as baptisms, communions, confirmations, bar mitzvahs, bat mitzvahs, and the like.

While many gift givers choose to give tangible gifts on such festive or religious occasions, it is also customary to give a monetary gift in the form of cash, check or gift certificate. A monetary gift allows the recipient the freedom to decide how the gift may be used.

At a wedding reception, for example, it is common that the gift givers place their gift to the newlyweds on a large table as they enter into the reception area. For those guests who prefer to give a monetary gift, a large bowl or wishing well structure is often provided to collect and store the gifts during the reception. The large bowl or wishing well structure is utilized in order to avoid the possibility of accidentally losing a gift or having a gift stolen from the reception area.

U.S. Pat. No. 5,100,002 describes a decorated gift receptacle assembled in the shape of a decorated wishing well and a kit for the assembly of the gift receptacle. The decorated wishing well-shaped gift receptacle comprises a bottom, four upright sides, and a roof formed of stiff sheet material. The roof comprises a pair of intersecting sloping sections, wherein at least one of the sides has an opening therein. The gift receptacle further comprises a horizontal slotted platform disposed below the opening in the roof and a plurality of overlapping strips of flexible decorative material, such as lace, affixed to the exterior surfaces of the gift receptacle.

There has also been an attempt to form a storage structure having the exterior appearance of the storage structure is a castle. U.S. Pat. No. 5,394,989, for example, describes a three-component miniature castle structure with a storage compartment. The structure has three distinct and separate, non-integral portions, namely, a removable top portion, a base portion and cloth sack. The miniature castle structure comprises a concealed storage compartment having an inner cavity, four sides, a bottom and an open top face, formed in a structure having the exterior shape of a castle base; a removable top covering formed in the exterior shape of a castle roof; and a plush cloth sack being located in the concealed storage compartment. The cloth sack is used to conceal human infant teeth that have been lost in the normal course of growth and development of human children.

Although gift receptacles having the exterior shape of non-decorated and decorated wishing wells are known in the prior art, heretofore, a gift receptacle constructed from self-supporting sheet material and assembled in the exterior shape of a castle structure has not been taught in the prior art, and remains an appealing alternative for many special or festive occasions.

BRIEF SUMMARY OF THE INVENTION

It is, therefore, an object of the present invention to provide a gift receptacle having the exterior appearance of a castle structure.

It is another object of the present invention to provide a kit for the assembly of a gift receptacle having the exterior appearance of a castle structure.

It is another object of the present invention to provide a method for forming a gift receptacle having the exterior appearance of a castle structure.

These and other objects, together with the advantages thereof over the gift receptacles, kits for assembly, and methods of forming gift receptacles known in the existing art, which shall become apparent from the specification which follows, are accomplished by the invention as hereinafter described and claimed.

The present invention, therefore, provides a gift receptacle comprising an integral base, said integral base comprising a foldable self-supporting sheet material folded into a bottom, four upright sides, and a roof having a centrally disposed slot; wherein said integral base has four corners and at least one of said corners has a corner slot therein; and wherein said integral base comprises an integral threshold tab joined to one of said upright sides; and at least one corner base tower, said corner base tower comprising a foldable self-supporting sheet material folded into an elongated cylindrical tower having opposing upper and lower ends and at least one tab portion that is inserted into said corner slot of said integral base, wherein said gift receptacle has the exterior appearance of a castle and is adapted to receive gifts, wherein said gift receptacle has the exterior appearance of a castle and is adapted to receive gifts.

In another embodiment, the present invention also provides a gift receptacle comprising an integral base, said integral base comprising a foldable self-supporting sheet material folded into a bottom, four upright sides, and a roof having a centrally disposed slot; wherein said integral base has four corners and at least one of said corners has a corner slot therein; and wherein said integral base comprises an integral threshold tab joined to one of said upright sides; at least one corner base tower, said corner base tower comprising a foldable self-supporting sheet material folded into an elongated cylindrical tower having opposing upper and lower ends and at least one tab portion that is inserted into said corner slot of said integral base; a rectangular roof tower base, said roof tower base comprising a foldable self-supporting sheet material folded into a bottom, four upright sides and a top, wherein said bottom of said roof tower base comprises opposing locking tabs thereon and said top of said roof tower base comprises at least one opening that is adapted to receive one end of a roof tower; at least one roof tower, said roof tower comprising a foldable self-supporting sheet material folded into an elongated cylindrical roof tower having opposing upper and lower ends, wherein said lower end of said roof tower is inserted into said rectangular tower base opening; and optionally at least one tower cap, said cap comprising a foldable self-supporting sheet material and that is inserted into the upper end of one of at least one said corner base tower and at least one roof tower.

The present invention further provides a kit for the assembly of a gift receptacle comprising: a flexible transparent waterproof package containing a plurality of pieces of self-supporting sheet material, each piece having fold lines thereon; wherein one piece of said self-supporting sheet material, when folded along said fold lines, forms an integral base of said gift receptacle, said integral base comprising a bottom, four upright sides, and a roof having a centrally disposed slot; wherein said integral base also has four corners and at least one of said corners has a corner slot therein and an integral threshold tab that is joined to the bottom edge of one of said upright sides, and at least one corner base tower, said corner base tower comprising a foldable self-supporting sheet material folded into an elongated cylindrical tower having opposing upper and lower ends and at least one tab portion that is inserted into said corner slot of said integral base, wherein said gift receptacle has the exterior appearance of a castle and is adapted to receive gifts.

In another embodiment, the present invention provides a kit for the assembly of a gift receptacle comprising: a flexible transparent waterproof package containing a plurality of pieces of self-supporting sheet material, each piece having fold lines thereon; wherein one piece of said self-supporting sheet material, when folded along said fold lines, forms an integral base of said gift receptacle, said integral base comprising a bottom, four upright sides, and a roof having a centrally disposed slot; wherein said integral base also has four corners and at least one of said corners has a corner slot therein and an integral threshold tab that is joined to the bottom edge of one of said upright sides; wherein another piece of said self-supporting sheet material, when folded along said fold lines, forms a corner base tower of said gift receptacle, said corner base tower comprising an elongated cylindrical tower having opposing upper and lower ends and at least one tab portion that is adapted to be inserted into said corner slot of said integral base; wherein another piece of said self-supporting sheet material, when folded along said fold lines, forms a rectangular roof tower base, said rectangular roof tower base comprising a bottom, four upright sides and a top, wherein said bottom of said roof tower base comprises opposing locking tabs thereon and said top of said roof tower base comprises at least one opening that is adapted to receive one end of a roof tower; wherein another piece of said self-supporting sheet material, when folded along said fold lines, forms a roof tower, said roof tower comprising an elongated cylindrical tower having opposing upper and lower ends, wherein said lower end of said roof tower is adapted to be inserted into said rectangular tower base opening; and optionally at least one self-supporting sheet material, when folded along said fold lines, forms a tower cap that is adapted to be inserted into the upper end of one of at least one said corner base tower and at least one roof tower; wherein said gift receptacle has the exterior appearance of a castle and is adapted to receive at least one gift.

The present invention further provides a method for forming a gift receptacle comprising the steps of: providing a plurality of pieces of self-supporting sheet material, each of said sheets having fold lines thereon which are foldable along the fold lines thereon to form one shape selected from the group consisting of an integral castle base and a corner base tower, folding one piece of said self-supporting sheet material along fold lines to form said integral castle base, wherein said integral base comprises a bottom, four upright sides, and a roof having a centrally disposed slot; wherein said base has four corners and at least one of said corners has a corner slot therein and an integral threshold tab that is joined to the bottom edge of one of said upright sides; and folding at least one piece of said self-supporting sheet material along fold lines to form said corner base tower, wherein said corner base tower comprises an elongated cylindrical tower having opposing upper and lower ends and at least one tab portion that is adapted to be inserted into said corner slot of said integral base; inserting said tab portion of at least one said corner base tower into said corner slots of said integral castle base, wherein the gift receptacle has the exterior appearance of a castle and is adapted to receive envelopes containing one selected from the group consisting of greeting cards, cash, checks, and gift certificates.

In another embodiment, the present invention further provides a method for forming a gift receptacle comprising the steps of: providing a plurality of pieces of self-supporting sheet material, each of said sheets having fold lines thereon which are foldable along the fold lines thereon to form one shape selected from the group consisting of an integral castle base, a corner base tower, a rectangular roof tower base, a roof tower, and optionally, a tower cap; folding one piece of said self-supporting sheet material along fold lines to form said integral castle base; wherein said integral base comprises a bottom, four upright sides, and a roof having a centrally disposed slot; wherein said base has four corners and at least one of said corners has a corner slot therein and an integral threshold tab that is joined to the bottom edge of one of said upright sides; folding at least one piece of said self-supporting sheet material along fold lines to form said corner base tower; wherein said corner base tower comprises an elongated cylindrical tower having opposing upper and lower ends and at least one tab portion that is adapted to be inserted into said corner slot of said integral base; inserting said tab portion of at least one said corner base tower into said corner slots of said integral castle base; folding one piece of said self-supporting sheet material along fold lines to form said rectangular roof tower base; wherein said rectangular roof tower base comprises a bottom, four upright sides and a top, wherein said bottom of said roof tower comprises opposing locking tabs thereon and said top of said roof tower base comprises at least one opening that is adapted to receive the lower end of a roof tower; placing said folded roof tower base onto the upper surface of said roof; folding at least one piece of said self-supporting sheet material along fold lines to form said roof tower; wherein said roof tower comprises an elongated cylindrical tower having opposing upper and lower ends, wherein the lower end of said roof tower is adapted to be inserted into said rectangular tower opening; inserting the lower end of at least one roof tower into said opening of the roof tower base; and optionally folding at least one piece of said self-supporting sheet material along the fold lines to form a tower cap and inserting said folded tower cap into the upper end of one of at least one said corner base tower and at least one roof tower; wherein the gift receptacle has the exterior appearance of a castle and is adapted to receive envelopes containing one selected from the group consisting of greeting cards, cash, checks, and gift certificates.

DETAILED DESCRIPTION OF THE INVENTION

The present invention provides a gift receptacle having the exterior appearance of a castle for special or festive occasions such as wedding receptions, bridal showers, baby showers, anniversaries, birthday parties, graduation parties, retirement parties, "house-warming" parties, and the like, and for religious occasions such as baptisms, communions, confirmations, bar mitzvahs, bat mitzvahs, and the like. The gift receptacle is adapted to receive gifts through a centrally disposed slot in the roof of the castle-shaped receptacle.

In general, the gift receptacle of the present invention comprises an integral base, the integral base comprising a foldable self-supporting sheet material folded into a bottom, four upright sides, and a roof having a centrally disposed slot. The integral base has four corners and at least one of the corners of the base has a corner slot located therein. The integral base also includes an integral threshold tab joined to one of the upright sides. The gift receptacle further includes at least one corner base tower, where the corner base tower comprises a foldable self-supporting sheet material folded into an elongated cylindrical tower having opposing upper and lower ends and at least one tab portion that is adapted to be inserted into the corner slot of the integral base.

The present invention will be described in further detail with reference to FIGS. 1–6.

Figure 1:
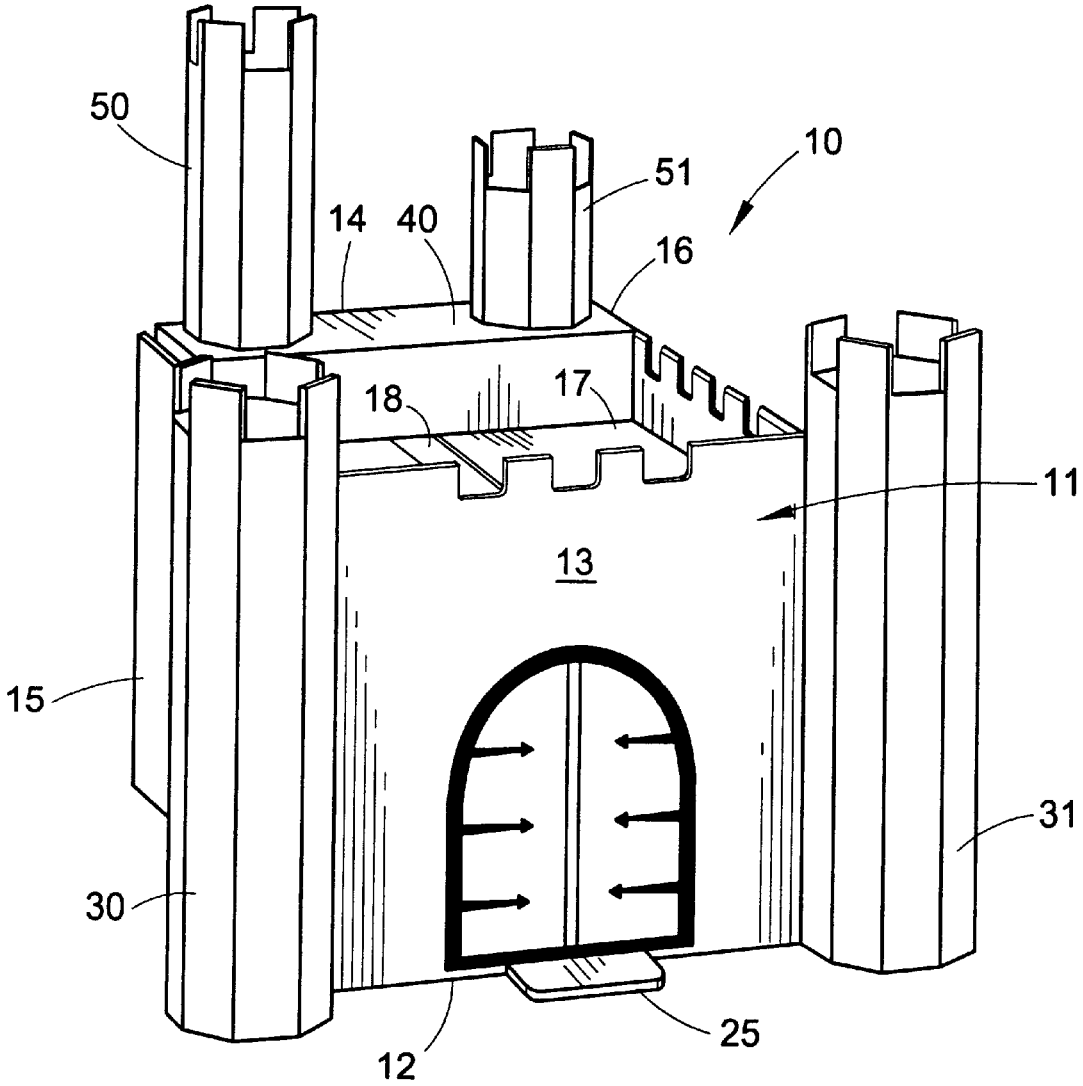
FIG. 1 is a perspective view of one embodiment of the assembled gift receptacle of the present invention.

With reference to FIG. 1, in one embodiment, the gift receptacle 10 comprises an integral base 11. The integral base 11 is formed from one flat piece of self-supporting sheet material that is folded into a bottom 12, four upright sides 13, 14, 15, 16 and a roof 17. The four upright sides comprise a front side 13, a back side 14, a left side 15 and a right side 16. The roof 17 has a centrally disposed slot 18. The integral base 11 has four corners 19, 20, 21, 22 and at least one of the corners of the integral base has a corner slot 23, 24 therein. The integral base 11 of the gift receptacle 10 also comprises an integral threshold tab 25 that is joined to the bottom edge of the front upright side 13 of the integral base 11. In a preferred embodiment, the front upright side 13 of the integral base has imprinted thereon an image of a castle door or doors.

The foldable, self-supporting sheet material is a rigid or semi-rigid material having two opposed flat surfaces or sides. The term "self-supporting", as used in the specification, refers to a sheet material which is stiff enough in the upright position, such that the assembled gift receptacle will stand without any sagging. Any material may be used as the self-supporting sheet material so long as the material is foldable and self-supporting. In a preferred embodiment, corrugated cardboard is utilized as the foldable, self-supporting sheet material. The corrugated cardboard may be any conventional corrugated cardboard comprising a thin flat cardboard layer which provides a first surface, a middle layer having parallel corrugations, and another thin flat cardboard layer which provides a second surface. In a preferred embodiment, the first and second surface of the corrugated cardboard material, which becomes the outer or exterior of the castle-shaped gift receptacle, is coated with a suitable pigment giving the outer surface a white colored appearance.

The gift receptacle 10 of the present invention also comprises at least one corner base tower 30, 31. Each of the corner base towers 30, 31 comprise a foldable self-supporting sheet material that is folded into an elongated cylindrical tower shape having opposing upper 32 and lower 33 ends and at least one tab portion 34, 35. The tab portion 34, 35 is adapted to be inserted into the corner slots 23, 24 of the integral base 11 of the gift receptacle. The upper ends 32 of the corner roof towers 30, 31 are castellated. The term "castellated", as used in the specification, refers to an ornamental feature having castle or castle-like appearance adorned with battlement-like structures. The term "battlement", as used in the specification, refers to a ornamental feature that is created by a plurality of rising parts separated by openings. Battlements have been traditionally built on the tops of castle walls or castle towers.

In one embodiment, the gift receptacle 10 of the present invention also comprises a rectangular tower base 40. The rectangular tower base 40 comprises a foldable self-supporting sheet material that is folded into a bottom 41, four upright sides 42, 43, 44, 45 and a top 46. The top 46 of the rectangular tower base 40 also comprises at least one opening 47*a*, 47*b* that is adapted to receive the lower end 53 of a roof tower 50, 51. The bottom side 41 further comprises opposing locking tabs 48*a*, 48*b* that are adapted to be inserted into slot locks in the roof 17 of the integral base 11 to secure the roof tower base 40 in place on top of the roof 17.

According to one embodiment, the gift receptacle 10 of the present invention also comprises at least one roof tower 50, 51. The roof tower 50, 51 comprises a foldable self-supporting sheet material that is folded into an elongated cylindrical tower shape having opposing upper 52 and lower 53 ends. The lower end 53 of the roof tower 50, 51 is adapted to be inserted into the opening 47*a*, 47*b* of the rectangular roof tower base 50, 51. The upper ends 52 of the roof towers 50, 51 are castellated as described hereinabove for the corner base towers 30, 31.

The gift receptacle 10 of the present invention may optionally comprise at least one tower cap 60. The tower caps 60 comprise a foldable self-supporting sheet material and are adapted to be inserted into the upper ends of one of the base towers 30, 31 and/or the roof towers 50,51. When assembled, the gift receptacle 10 has the exterior appearance of a castle structure and is adapted to receive gifts through slot 18.

Figure 2:
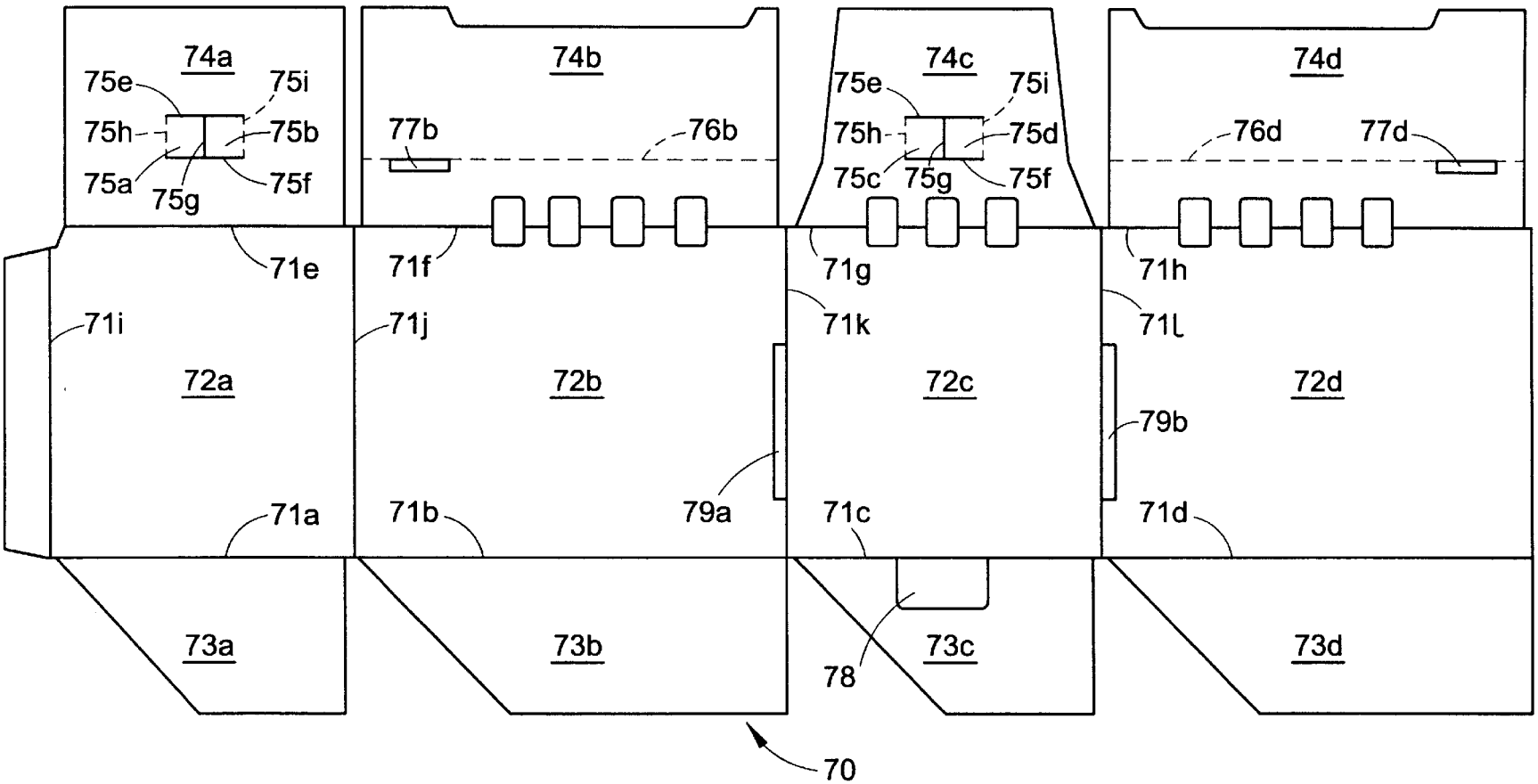
FIG. 2 is a plan view of a piece of self-supporting sheet material that, when folded, forms the integral base of the gift receptacle of the present invention.

FIG. 2 shows one flat piece of the foldable self-supporting sheet material 70 having fold lines thereon. The self-supporting sheet material 70 has two sides and a plurality of fold lines 71*a*–71*l* thereon, which divide the sheet material into a plurality of panels or sections 72*a*, 72*b*, 72*c*, 72*d*. Panels 72*a*, 72*b*, 72*c*, and 72*d* form the four upright sides of the gift receptacle of the present invention. When folded, panel 72*c* becomes the front upright side of the gift receptacle, panel 72*b* becomes the left upright side of the gift receptacle, panel 72*d* becomes the right upright side of the gift receptacle and panel 72*b* becomes the back upright side of the gift receptacle. Left front corner slot 79*a* and right front corner slot 79*b* are cut out from the sheet material. The corner slots 79*a* and 79*b* are adapted to receive the tab portions of the corner base towers.

Four angled flaps 79*a*, 79*b*, 79*c*, 79*d* are joined to the bottom edges of panels 72*a*, 72*b*, 72*c*, and 72*d*, along fold lines 71*a*–71*d*, respectively. Angled flaps 79*a*, 79*b*, 79*c* and 79*d* form the bottom of the integral base 11 of the gift receptacle 10 of the present invention.

Panels 74*a*, 74*b*, 74*c* and 74*d* are joined to the top edges of panels 72*a*, 72*b*, 72*c*, and 72*d* along fold lines 71*e*–71*h*. Panels 74*b* and 74*d* form the roof of the integral base 11 of the gift receptacle 10 of the present invention. Panels 74*a* and 74*c* are fold-down flaps. Fold-down panels 74*a* and 74*c* also comprise support flaps 75*a*, 75*b*, 75*c* and 75*d* thereon. Support flaps 75*a*, 75*b*, 75*c* and 75*d* are cut out from panels 74*a* and 74*c* along cut-out lines 75*e*, 75*f* and 75*g*, but remained joined to panels 74*a* and 74*c* along fold lines 75*h* and 75*i*. Flap 74*a* is folded down against the inside surface of panel 72*a* and flap 74*c* is folded down against the inside surface of panel 72*c*. When folded down, flaps 74*a* and 74*c* and support flaps 75*a*, 75*b*, 75*c*, and 75*d* provide support for roof panels 74*b* and 74*d*. When panels 74*b*, and 74*d* are folded down, the upper edges of the upright sides of the integral base have a castellated appearance as described hereinabove.

As described hereinabove, panels 74*b* and 74*d* form the roof of the gift receptacle 10 of the present invention. Panels 74*b* and 74*d* have additional fold-down lines 76*b* and 76*d*. Panels 74*b* and 74*d* also have slot locks 77*b* and 77*d* that are adapted to receive the opposing locking tabs of the bottom surface of the rectangular roof tower base.

Figure 3:
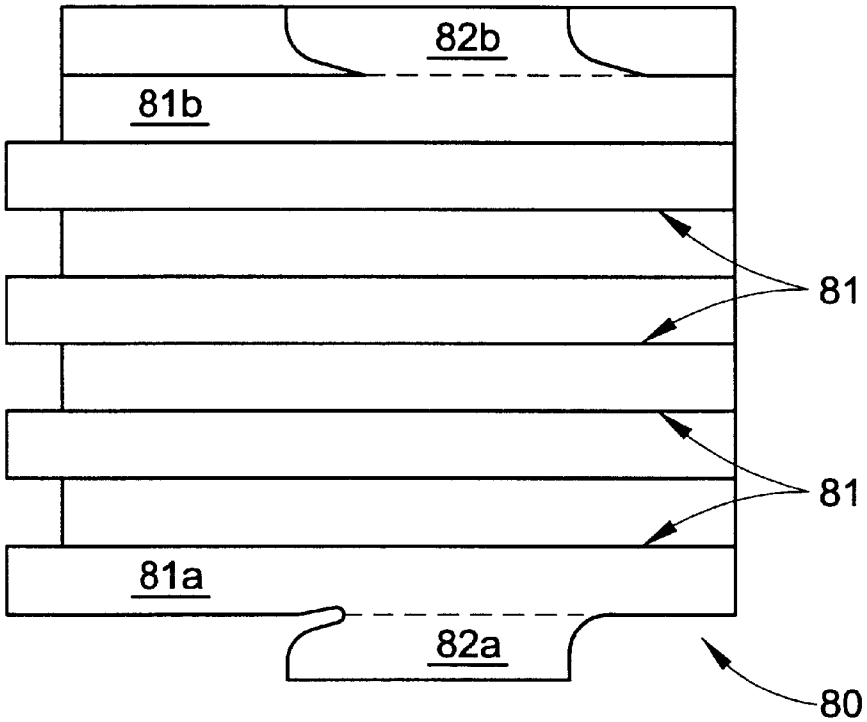
FIG. 3 is a plan view of a piece of self-supporting sheet material that, when folded, forms the corner base towers of the gift receptacle of the present invention.

FIG. 3 shows a flat piece of self-supporting sheet material 80 that is folded into the corner base towers 30, 31. Self-supporting sheet 80 has a plurality of fold lines 81 thereon, which are folded into a plurality of panels. End panels 81*a*, 81*b* also comprise tabs 82*a* and 82*b*. Tabs 82*a* and 82*b* are adapted to be inserted into the corner slots 23 and 24 of the integral base 11 of the gift receptacle of the present invention. End panels 81*a*, 81*b* are preferably joined together to provide further support for the gift receptacle 10. End panels 81*a* and 81*b* are preferably joined or bonded together by any conventional means of bonding such as, but not limited to, glue, staples or tape.

Figure 4:
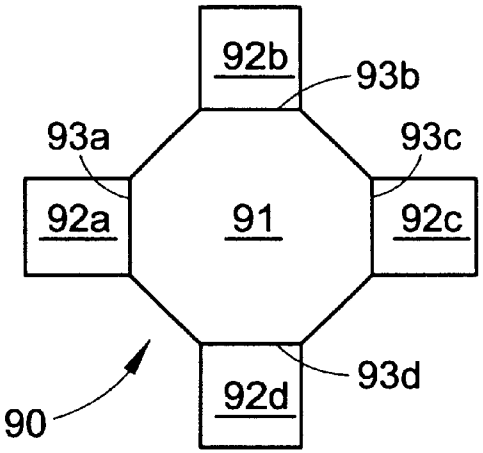
FIG. 4 is a plan view of a piece of self-supporting sheet material that, when folded, forms the tower caps of the gift receptacle of the present invention.

FIG. 4 shows a flat piece of self-supporting sheet material 90. The self-supporting sheet material comprises a central region 91 and a plurality of fold-up tabs 92*a*, 92*b*, 92*c*, and 92*d*, which are joined to central region 91 at fold-up lines 99*a*, 99*b*, 99*c*, and 93*d*, respectfully. When folded, along fold-up lines 99*a*, 99*b*, 99*c*, and 93*d*, the sheet material forms the tower caps for either the base towers 30, 31 and/or the roof towers 50, 51. It is envisioned that any of the corner base towers and/or the roof towers may or may not be capped with the tower caps. In a preferred embodiment, the corner base towers are capped with the tower caps, while the roof towers are not.

Figure 5:
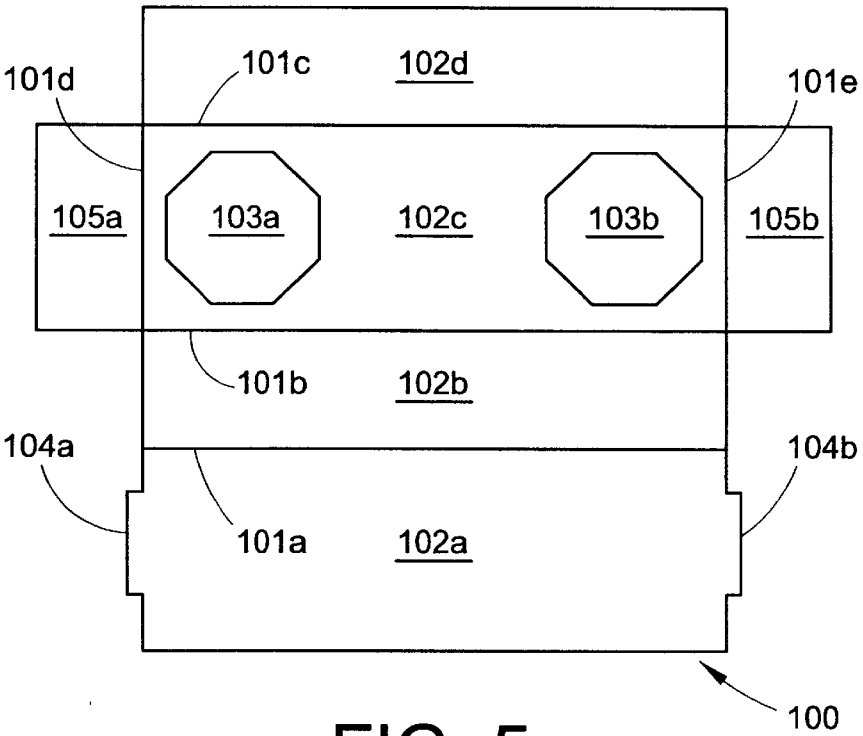
FIG. 5 is a plan view of a piece of self-supporting sheet material that, when folded, forms the roof tower base of the gift receptacle of the present invention.

FIG. 5 shows a flat piece of self-supporting sheet material 100. Self-supporting sheet material 100 comprises fold lines 101*a*, 101*b*, 10*c*, 101*d*, and 101*e*, which divide self-supporting sheet material 100 into panels 102*a*, 102*b*, 102*c* and 102*d*. Panel 102*a* also comprises opposing locking tabs 104*a* and 104*b*. Panel 102*c* also comprises flaps 105*a* and 105*b* and at least one shaped opening 109*a*, 103*b*. When folded, self-supporting sheet material 100 forms the shape of the rectangular roof tower base 40. Locking tabs 104*a* and 104*b* provided on the bottom of the rectangular roof tower base, and are adapted to be inserted into locking slots 77*b* and 77*d* located on roof panels 74*b* and 74*d* to secure the roof tower base 40 in place.

Figure 6:
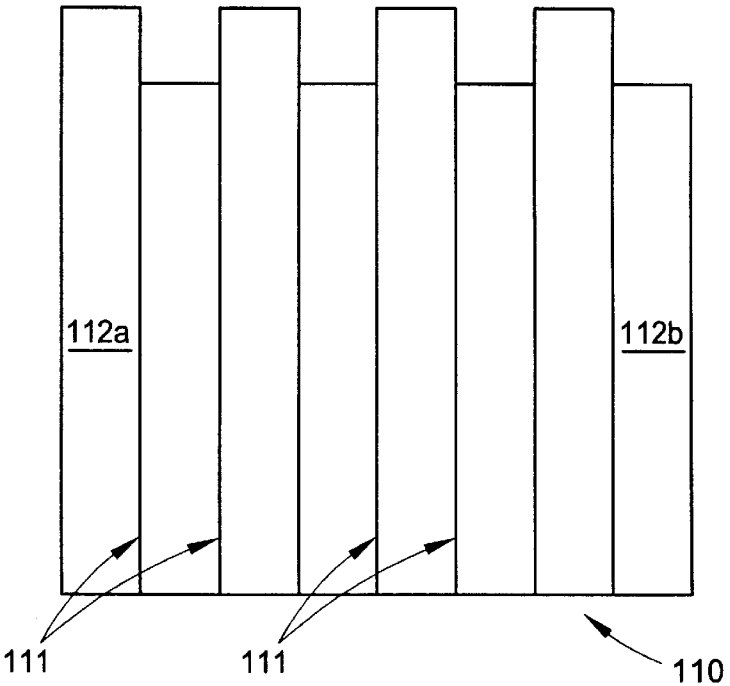
FIG. 6 is a plan view of a piece of self-supporting sheet material that, when folded, forms the roof towers of the gift receptacle of the present invention.

FIG. 6 shows a flat piece of self-supporting sheet material 110 having fold lines 111 thereon, which divide the sheet 110 into a plurality of panels 112. When folded, self-supporting sheet material 110 forms the roof towers 50, 51 of the gift receptacle 10 of the present invention. The end panels 112*a* and 112*b* may or may not be bonded together. Preferably, end panels 112*a* and 112*b* are not bonded together. In a preferred embodiment, there are two roof towers inserted into separate openings in the rectangular roof tower base. Although the roof towers may be the same height or may have different heights. In a preferred embodiment, the roof towers have different heights, namely one six inch roof tower and one eight inch roof tower.

The gift receptacle of the present invention may be assembled in any dimensions. Representative and preferred, but not limiting, dimensions for the gift receptacle of the present invention are set forth in Table I below:

TABLE I

| Representative Dhnensions of the Castle-Shaped Gift Receptacle | |
|---|---|
| Width | 16.5" |
| Depth | 16.5" |
| Height | 19" |

The present invention further provides a method for the assembly of a gift receptacle having the exterior appearance or shape of a castle structure. The kit 120 according to the present invention comprises a flexible transparent water-proof package 130 constructed from a plastic sheet material. The plastic package 130 contains all of the materials required for the assembly of the gift receptacle of the present invention. The plastic sheet material may comprise any known plastic material that can be sealed, and is transparent and water-proof. The flexible, waterproof package can be selected from polyethylene (PE), polypropylene (PP), and polyvinyl chloride (PVC). A preferred plastic sheet material is polyvinyl chloride (PVC).

Figure 7:
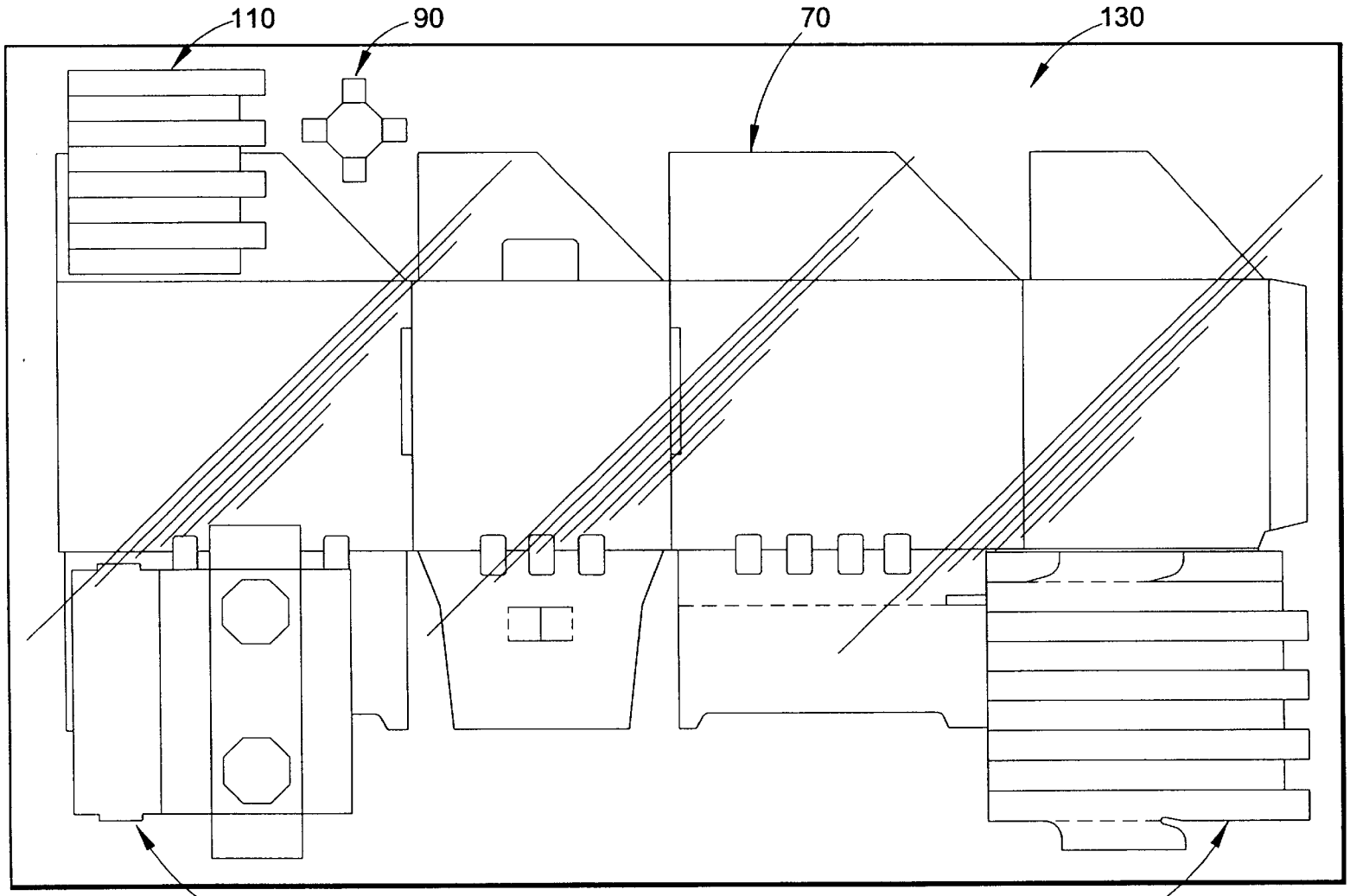
FIG. 7 is a front elevational view of the kit of the present invention containing the required materials for the assembly of the gift receptacle.

FIG. 7 shows one embodiment of the kit of the present invention. The plastic package 130 may be formed by any conventional means. For example, the plastic sheeting material may be folded along the transverse center line and sealed along the other three edges by stretching or heat sealing after all of the require materials have been placed inside.

The kit contains a plurality of separate pieces of foldable self-supporting material sheets that are to be folded into the different component shapes of the gift receptacle of the present invention. The kit of the present invention contains one piece of said self-supporting sheet material has fold lines thereon that, when folded along said fold lines, forms the integral base of the gift receptacle. The integral base comprises a bottom, four upright sides, and a roof having a centrally disposed slot. The base has four corners and at least one of the corners has a corner slot therein and an integral threshold tab. The integral threshold tab is joined to the bottom edge of the front upright side of the integral base of the gift receptacle.

The kit of the present invention also contains at least one piece of said self-supporting sheet material has fold lines thereon that, when folded along said fold lines, forms the corner base towers of the gift receptacle. The corner base tower is formed by folding a flat piece of self-supporting sheet material into an elongated cylindrical tower having opposing upper and lower ends and at least one tab portion that is adapted to be inserted into the corner slot of the integral base.

In another embodiment, the kit of the present invention further contains one piece of foldable self-supporting sheet material that has fold lines thereon that, when folded along said fold lines, forms the rectangular roof tower base. The rectangular roof tower base comprises a bottom, four upright sides and a top. The top of the roof tower base comprises at least one opening that is adapted to receive one end of a roof tower. The bottom of the roof tower base also comprises opposing locking tabs that are adapted to be inserted into the locking slots of the roof panel of the integral base. The locking tabs secure the roof tower base in place on the upper surface of the gift receptacle of the present invention.

According to one preferred embodiment, the kit of the present invention further contains at least one piece of self-supporting sheet material that has fold lines thereon that, when folded along said fold lines, forms the roof towers of the gift receptacle. The roof towers comprise an elongated cylindrical shape having opposing upper and lower ends, wherein one end of the roof tower is adapted to be inserted into the openings of the rectangular tower roof tower base.

The kit of the present invention optionally contains at least one self-supporting sheet material having fold lines thereon that, when folded along said fold lines, forms the tower caps of the gift receptacle. The tower caps are adapted for insertion into the upper end of either the base towers and/or roof towers.

The flexible plastic package 130 also contains a printed sheet, booklet, pamphlet, or brochure having the detailed instructions 140 for the assembly of the castle-shaped gift receptacle 10 of the present invention printed thereon.

The present invention also provides a method for assembling the gift receptacle of the present invention. The method for assembling the gift receptacle, according to the present invention, comprises providing a plurality of pieces of self-supporting sheet material. Each of the sheets have fold lines thereon, which are foldable along the fold lines thereon to form a different part of the gift receptacle 10, such as the integral castle base 11, the corner base towers 30, 31, and in other preferred embodiments, the roof tower base 40, the roof towers 50, 51, and optionally, the tower caps 60.

To begin the assembly of the gift receptacle, one must first open the flexible waterproof package 130 and remove the plurality of pieces of foldable self-supporting sheet material and instructions. Each piece of the foldable, self-supporting sheet material is placed on a clean, flat, horizontal surface such as a table or a floor. There is no particular required order for the assembly of the individual component shapes of the gift receptacle of the present invention. However, it is preferable to assemble the integral base first.

To assemble the integral base, panels 72*a*, 72*b*, 72*c*, and 72*d* of self-supporting sheet material 70 are folded along fold lines 71*i*–71*l* to "square-up" the castle structure. The bottom 12 of the integral base of the castle-shaped gift receptacle is formed by folding in and interlocking panels 79*a*, 79*b*, 79*c* and 73*d*. The roof is formed by first folding down panels 74*a* and 74*c* against a portion of the inside surface of panels 72*a* and 72*c*, respectively. After panels 74*a* and 74*c* have been folded down, panels 74*b* and 74*d* are folded down along fold lines 71*e*–71*h*, respectively. A portion of the top edges of roof panels 74*b* and 74*d* are notched. Roof panels 74*b* and 74*d* are then folded along folded lines 76*b* and 76*d* and the non-notched portions of the top edges of each panel are brought together in intimate contact to form the horizontal roof with a centrally disposed slot.

The integral threshold tab is joined to the bottom edge of the front upright side of the gift receptacle. Once the integral base has been formed, the threshold tab is folded away from the base of the gift receptacle. When folded out, the threshold tab is adapted to lay flat on a horizontal surface.

Another piece of said self-supporting sheet material is along fold lines to form the elongated cylindrical corner base towers 30, 31 having opposing upper and lower ends having at least one tab portion that is adapted to be inserted into the corner slots of the integral base. The tab portions of the end panels of the corner base towers may be bonded together by any conventional means of bonding such as glue, staples or tape. As described above, the integral base 11 has four corners and at least one of the corners has a slot therein. After the corner base towers are formed, the tab portions are inserted into the corner slots of the integral castle base.

In another embodiment, another piece of self-supporting sheet material is folded along fold lines to form the roof tower base 40 having a bottom, four upright sides and a top. The top of the roof tower base has at least one opening that is adapted to receive one end of a roof tower. The roof tower base 40 is then placed onto the upper surface of the roof of the integral base of the gift receptacle. The opposing locking tabs, which are located on the bottom surface of the roof tower base, are then inserted into the locking slots of roof panels 74*b* and 74*d*.

Another piece of the self-supporting sheet material is folded along fold lines to form the elongated cylindrical roof towers 50, 51 The roof towers 50, 51 have opposing upper and lower ends. The lower ends are adapted to be inserted into the openings of the rectangular tower base 40. At least one roof tower is then inserted into the opening of the roof tower base. Preferably, the lower ends two roof towers having different heights are inserted into separate openings in the roof tower base.

Optionally, at least one piece of the self-supporting sheet material is folded along the fold lines to form tower caps 60 that are adapted to be inserted in the upper ends the corner base towers 30, 31 and/or the roof towers 50, 51. If formed, the tower caps 60 are then inserted into the upper ends of the base towers and/or the roof towers. In a preferred embodiment, the corner base towers are capped, while the roof towers are not.

Once the castle-shaped gift receptacle has been properly assembled, the exterior surfaces of the integral base, corner base towers, roof tower base and roof towers can be further decorated in any fashion. One may utilize any type of arts and crafts supplies to decorate the exterior of the castle-shaped gift receptacle including, but not limited to, colored construction paper, ribbon, wired ribbon, streamers, lace, pennants, flags, stickers, decals, paints, markers, colored pencils, and glitter. For example, the roof towers may be capped by preparing cones with colored construction paper. The towers may additionally have flags or pennants placed in the top of the colored cone structures. If the gift receptacle is used at a wedding reception, ceramic or plastic figurines in the shape of a bride and broom may be positioned on the upper surface of the threshold of the castle-shaped gift receptacle.

When assembled, the gift receptacle has the exterior appearance of a castle and is adapted to receive envelopes, greeting cards, cash, checks, and gift certificates, and can be used at any special or festive occasion.

Based on the foregoing disclosure, it is therefore demonstrated that the objects of the present invention are accomplished by the gift receptacle and kit for assembly as described herein. It should be understood that the selection of additional specific decorations can be determined by one having ordinary skill in the art without departing from the spirit of the invention herein disclosed and described. It should therefore be appreciated that the present invention is not limited to the specific embodiments described above, but includes variations, modifications and equivalent embodiments defined by the following claims.

What is claimed is:

1. A gift receptacle comprising:

an integral base, said integral base comprising a foldable self-supporting sheet material folded into a bottom, four upright sides, and a roof having a centrally disposed slot; wherein said integral base has four corners and at least one of said corners has a corner slot therein; and wherein said integral base comprises an integral threshold tab joined to the bottom edge of one of said upright sides; and at least one corner base tower, said corner base tower comprising a foldable self-supporting sheet material folded into an elongated cylindrical tower having opposing upper and lower ends and at least one tab portion that is inserted into said corner slot of said integral base, wherein said gift receptacle has the exterior appearance of a castle and is adapted to receive gifts.

2. The gift receptacle of claim 1, wherein said upright sides comprise a front side, a left side, a right side and a back side.

3. The gift receptacle of claim 2, wherein said front upright side comprises an image of a castle door structure imprinted thereon.

4. The gift receptacle of claim 1, wherein the self-supporting sheet material is corrugated cardboard having opposing exterior and interior sides.

5. The gift receptacle of claim 4, wherein said exterior side of said corrugated cardboard comprises a white pigment.

6. The gift receptacle of claim 1, wherein the gift is selected from the group consisting of greeting cards, cash, checks, and gift certificates.

7. The gift receptacle of claim 1, further comprising a rectangular roof tower base, said roof tower base comprising a foldable self-supporting sheet material folded into a bottom, four upright sides and a top, wherein said bottom of said roof tower base comprises opposing locking tabs and said top of said roof tower base comprises at least one opening that is adapted to receive one end of a roof tower;

at least one roof tower, said roof tower comprising a foldable self-supporting sheet material folded into an elongated cylindrical roof tower having opposing upper and lower ends, wherein said lower end of said roof tower is inserted into said rectangular tower base opening; and optionally at least one tower cap, said cap comprising a foldable self-supporting sheet material and that is adapted to be inserted into the upper end of one of said base tower and roof tower.

8. The gift receptacle of claim 7, wherein said upright sides comprise a front side, a left side, a right side and a back side.

9. The gift receptacle of claim 8, wherein said front upright side comprises an image of a castle door structure imprinted thereon.

10. The gift receptacle of claim 7, wherein the self-supporting sheet material is corrugated cardboard having opposing exterior and interior sides.

11. The gift receptacle of claim 10, wherein said exterior side of said corrugated cardboard comprises a white pigment.

12. The gift receptacle of claim 7, wherein the gift is selected from the group consisting of greeting cards, cash, checks, and gift certificates.

13. A kit for the assembly of a gift receptacle comprising:

a flexible transparent waterproof package containing a plurality of pieces of self-supporting sheet material, each piece having fold lines thereon;

wherein one piece of said self-supporting sheet material, when folded along said fold lines, forms an integral base of said gift receptacle, said integral base comprising a bottom, four upright sides, and a roof having a centrally disposed slot; wherein said integral base has four corners and at least one of said corners has a corner slot therein and an integral threshold tab that is joined to the bottom edge of one of said upright sides; and wherein another piece of said self-supporting sheet material, when folded along said fold lines, forms a corner base tower of said gift receptacle, said corner base tower comprising an elongated cylindrical tower having opposing upper and lower ends and at least one tab portion that is adapted to be inserted into said corner slot of said integral base, wherein said gift receptacle has the exterior appearance of a castle and is adapted to receive at least one gift.

14. The kit of claim 13, wherein the flexible sheet material is a plastic material.

15. The kit of claim 14, wherein the plastic material is selected from the group consisting of polyethylene, polypropylene and polyvinyl chloride.

16. The kit of claim 15, wherein the plastic material is polyvinyl chloride.

17. The gift receptacle of claim 13, wherein said upright sides comprise a front side, a left side, a right side and a back side.

18. The gift receptacle of claim 17, wherein said front upright side comprises an image of a castle door structure imprinted thereon.

19. The gift receptacle of claim 18, wherein the self-supporting sheet material is corrugated cardboard having opposing exterior and interior sides.

20. The gift receptacle of claim 19, wherein said exterior side of said corrugated cardboard comprises a white pigment.

21. The kit of claim 13, wherein the kit comprises another piece of said self-supporting sheet material, when folded along said fold lines, forms a rectangular roof tower base, said rectangular roof tower base comprising a bottom, four upright sides and a top, said top of said tower base comprising at least one opening that is adapted to receive one end of a roof tower;

wherein another piece of said self-supporting sheet material, when folded along said fold lines, forms a roof tower, said roof tower comprising an elongated cylindrical tower having opposing upper and lower ends, wherein said lower end of said roof tower is adapted to be inserted into said rectangular tower base opening; and optionally at least one self-supporting sheet material, when folded along said fold lines, forms a tower cap that is adapted to be inserted into the upper end of one of said corner base tower and roof tower.

22. A method for forming a gift receptacle comprising the steps of:

providing a plurality of pieces of self-supporting sheet material, each of said sheets having fold lines thereon which are foldable along the fold lines thereon to form one shape selected from the group consisting of an integral castle base, and at least one corner base tower;

folding one piece of said self-supporting sheet material along fold lines to form said integral castle base; wherein said integral base comprises a bottom, four upright sides, and a roof having a centrally disposed slot; wherein said base has four corners and at least one of said corners has a corner slot therein and an integral threshold tab that is joined to the bottom edge of one of said upright sides;

folding at least one piece of said self-supporting sheet material along fold lines to form said corner base tower; wherein said corner base tower comprises an elongated cylindrical tower having opposing upper and lower ends and at least one tab portion that is adapted to be inserted into said corner slot of said integral base; and inserting said tab portion of said corner base tower into said corner slots of said integral castle base, wherein the gift receptacle has the exterior appearance of a castle and is adapted to receive envelopes containing one selected from the group consisting of greeting cards, cash, checks, and gift certificates.

23. The method of claim 22, further comprising providing a plurality of pieces of self-supporting sheet material, each of said sheets having fold lines thereon which are foldable along the fold lines thereon to form one shape selected from the group consisting of a rectangular roof tower base, at least one roof tower and, optionally, at least one tower cap;

folding one piece of said self-supporting sheet material along fold lines to form said rectangular roof tower base; wherein said rectangular roof tower base comprises a bottom, four upright sides and a top, said top of said tower base comprising at least one opening that is adapted to receive one end of a roof tower; placing said folded roof tower base onto the upper surface of said roof;

folding at least one piece of said self-supporting sheet material along fold lines to form said roof tower; wherein said roof tower comprises an elongated cylindrical tower having opposing upper and lower ends, wherein one end of said roof tower is adapted to be inserted into said rectangular tower opening;

inserting at least one roof tower into said opening of the roof tower base; and optionally folding at least one piece of said self-supporting sheet material along the fold lines to form a tower cap and inserting said folded tower cap into the upper end of one of said corner base tower and roof tower.

* * * * *